United States Patent [19]

Poutiainen

[11] Patent Number: 4,528,828

[45] Date of Patent: Jul. 16, 1985

[54] PADLOCK

[75] Inventor: Heikki Poutiainen, Joensuu, Finland

[73] Assignee: Oy Wärtsilä Ab, Helsinki, Finland

[21] Appl. No.: 456,387

[22] Filed: Jan. 7, 1983

[51] Int. Cl.[3] ..... E05B 67/22

[52] U.S. Cl. ..... 70/38 A; 70/435

[58] Field of Search ..... 70/38 A, 39, 53, 38 R, 70/38 B, 38 C, 432, 435

[56] References Cited

U.S. PATENT DOCUMENTS

| | | | |
|---|---|---|---|
| 206,327 | 7/1878 | Hillebrand | 70/39 |
| 4,112,715 | 9/1978 | Oyeda | 70/38 A |
| 4,138,866 | 2/1979 | Richards | 70/38 A |

FOREIGN PATENT DOCUMENTS

| | | | |
|---|---|---|---|
| 686327 | 3/1965 | Italy | 70/39 |

*Primary Examiner*—Robert L. Wolfe

*Attorney, Agent, or Firm*—John Smith-Hill

[57] ABSTRACT

A padlock comprises a lock casing and a basically U-formed shackle slideable therein between a closed and an open position. The padlock has two legs of different length, each provided with a locking notch. The longer leg has a head that is somewhat thicker than the general part of the leg for keeping the shackle engaged in the casing in its open position. There is also a cylinder lock mechanism, operable by a key, and locking members coacting with a guiding portion of a turnable member of the cylinder lock mechanism for locking both legs of the shackle to the lock casing. The locking members are movable dependent on the angular position of the guiding portion of the cylinder lock mechanism between a locking and a releasing position. The releasing position allows the shorter shackle leg to completely slide out from the lock casing. The padlock also comprises means allowing disengagement of the shackle from the lock casing upon turning the cylinder lock mechanism by means of the key into or past the releasing position, while the cylinder lock mechanism is in the casing.

10 Claims, 11 Drawing Figures

Fig. 2
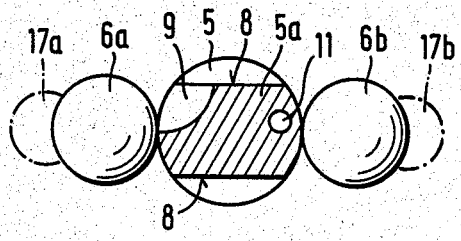
Fig. 5
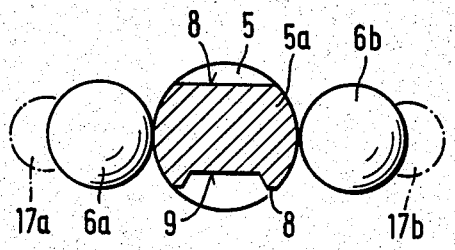
Fig. 3
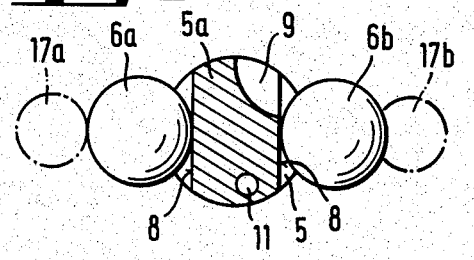
Fig. 6
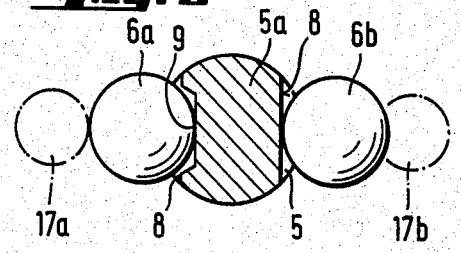
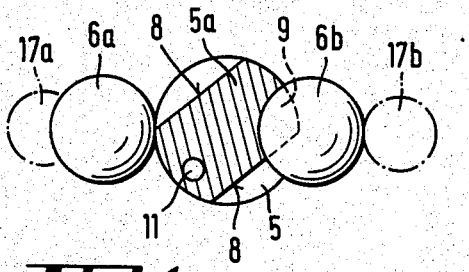
Fig. 4
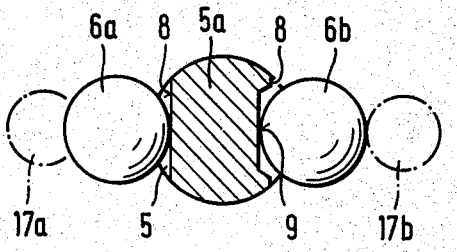
Fig. 7
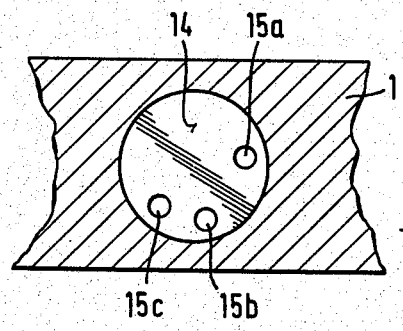
Fig. 8

PADLOCK

BACKGROUND OF THE INVENTION

The invention relates to a padlock. There are previously known padlocks with removable shackles. An example of this is shown, for instance, in U.S. patent application Ser. No. 240,193, filed 03-03-1981. In this known padlock, the replacement of the shackle is possible only when the lock casing is opened and the lock mechanism removed. The removement of the lock mechanism is a complicated procedure.

SUMMARY OF THE INVENTION

Padlocks are needed for several purposes, e.g. for the locking of doors, bicycles, boats, outboard motors etc. Characteristic for the use of padlocks is, that they are used when and where the need for a lock is not constant. For objects with a constant locking need, it is often more advantageous to include the lock in the basic structure of said object. This is the case, for instance, in normal door locks. In contrast to this, a padlock can be used for different purposes from time to time.

The use restricting factors of a padlock are the shape and the size of the shackle. To make the use of one padlock possible for varying purposes, it is essential that the replacement of the shackle is a simple operation.

The main object of the present invention is to provide a cylinder padlock with an easily removable shackle, which the user of the lock can replace when the purpose of the lock changes. The most expensive part of a padlock is the lock mechanism, while the shackles are fairly unexpensive and mechanically simple. This makes it advantageous for users of padlocks to operate with one or a few lock mechanisms, which can be combined with a plurality of shackles of different types.

The advantage of easy shackle replacement can be untilized also at the selling moment of the lock. The locks can be kept in stock as separate shackles and lock casings which are assembled at the moment of purchase.

The strength of a padlock very much depends on the length of the shackle, shorter shackles being stronger against torquing with a pipe wrench or similar tools, and shorter shackles also being harder to attack with bolt cutters or similar. Therefore it is advantageous to use shackles which are as short as possible, and to make the shackles from hardened steel.

The object of the invention is obtained by means of a lock comprising a lock casing and a U-formed shackle slideable therein. The shackle has two legs of different length, each provided with a locking notch. The head of the longer leg is somewhat thicker than the general part of the leg. The lock also comprises a cylinder lock mechanism, operable by a key, locking members, and means allowing disengagement of the shackle from the lock casing.

In a cylinder operated padlock, the radial position of the locking members in relation to the cylinder lock mechanism can be controlled by arranging suitable radial recesses in a guiding portion of the cylinder. As a result of this, the thickness of the different portions of the shackle determines to which extent the shackle can be out drawn from the lock casing. According to the invention, three different positions for the locking members are possible. They can be in locking, releasing or in "shackle disengagement" position. The last mentioned position allows a complete disengagement of the shackle from the lock casing.

According to the invention, the shackle can be removed even if the radial recesses in the guiding portion of the cylinder are arranged so, that only two different positions, locking and releasing, are possible for the locking members. However, in this case the removal of the shackle requires that the head of the longer shackle leg is detachable from the general part of the longer leg or, that said head is equipped with a suitable groove, dimensioned to coact with the locking member associated with this leg.

BRIEF DESCRIPTION OF THE DRAWINGS

FIGS. 2–4 show different positions of the locking members relative the guiding portion of the lock cylinder. FIG. 2 shows the locking position, FIG. 3 shows the releasing position, and FIG. 4 the shackle disengagement position.

FIGS. 5–7 show another recess arrangement. In this case

FIG. 5 shows the locking position, FIG. 6 the releasing position and FIG. 7 the shackle disengagement position.

FIG. 8 shows indicating recesses in the lock casing.

DESCRIPTION OF THE PREFERRED EMBODIMENTS

Figure 1:
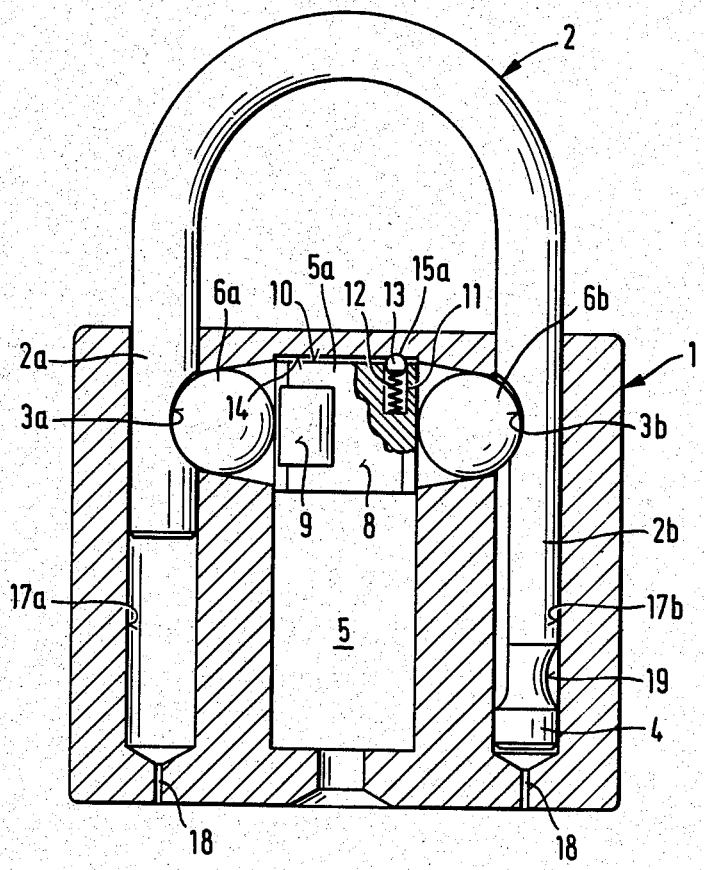
FIG. 1 is a shackle-plane section of a locked padlock according to the invention.

In the drawing, reference numeral 1 indicates a lock casing and numeral 2 a shackle with two legs **2*a* and 2*b* of different length. In the lock casing there are bores 17*a* and 17*b* for said legs. The shackle legs are provided with notches 3*a* and 3*b* receiving spherical locking members 6*a* and 6*b*. The head 4 of the longer shackle leg 2*b* is somewhat thicker than the general part of this leg. The padlock is operated from a cylinder lock mechanism 5. The mounting of this mechanism in the lock casing is made in a conventional way and is not shown in the drawing. The casing is provided with drain openings 18**.

Locking members **6*a* and 6*b* are guided by the cylinder lock mechanism 5 so, that they move radially outwards relative the cylinder into notches 3*a* and 3*b* of shackle 2 when the cylinder lock mechanism is turned by a key (not shown) into locking position. Thus, shackle 2 is firmly locked to lock casing 1 at two positions. When the padlock is to be opened, cylinder lock mechanism 5 is first turned into its releasing position, which means that recesses 8, located at the guiding portion 5*a* of the cylinder lock mechanism, are brought to face members 6*a* and 6*b* (FIGS. 2–7). Shackle 2 is now slideable so far out from lock casing 1, that the shorter leg 2*a* is free to completely leave its bores 17*a*, but the head 4 of shackle 2 is still locked in bores 17*b* by locking member 6*b*. The shackle is provided with a groove 19**, dimensioned to make the turning of the shackle possible when the shackle is in its open position.

According to the invention the shackle can be disengaged from the lock casing in different ways. Firstly, the guiding portion of the cylinder lock mechanism can be provided with another recess 9, allowing locking member **6*b* to radially move a bit further inwards against the cylinder lock mechanism, when turning the mechanism further from its releasing position, as shown in FIGS. 3–4 and 6–7. The radial movement of locking member 6***a* outwards does not disturb the function of the lock in this case because the shorter shackle leg is out of bores 17*a* when the shackle is in open position. The position of locking member 6*b* thereby allows the complete disengagement of the shackle from the casing. Shackle 2 can then be replaced by another one. The locking process preceds in the reverse order. This is the best mode of the invention.

It is advantageous, in this case, to provide the padlock with an indicating system, helping the user of the lock to recognize when the position of the locking members relative the cylinder lock mechanism makes the different operations possible, in other words, indicating in which position the mechanism is. This can be arranged as shown in FIGS. 1 and 8. In the inner end surface 10 of the cylinder lock mechanism 5, there is a bore 11 in which a spring member 12 and an indicator member 13 are arranged. The outer surface of the indicator member 13 is shaped to coact with corresponding recesses 15*a*, 15*b* and 15*c* in the cylinder end surface 14 in lock casing 1. When the mechanism is in closing position, indicator member 13 is in recess 15*a*. When turning the cylinder lock mechanism the indicator member 13 is forced into bores 11, from where it moves into recess 15*b*, when the mechanism is in releasing position. Recess 15*c* indicates when the cylinder is in position for shackle disengagement. In the embodiment shown, the guiding portion 5*a* of the cylinder lock mechanism is in the inner end of this mechanism. This is however not a necessity. The position of the guiding portion, as well as the position of the indicating system can vary. The indicating system can be located, for instance, at the mantle surface of the cylinder lock mechanism.

Figure 9:
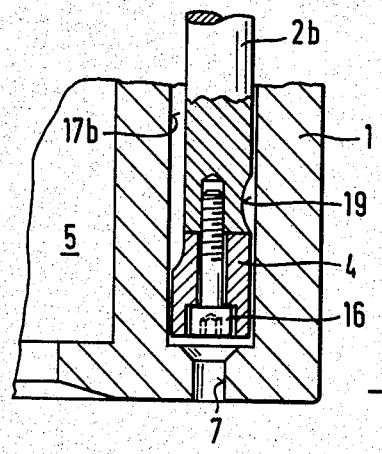
FIGS. 9–10 show the attachement of the head of the longer shackle leg to the general part of this leg.
Figure 10:
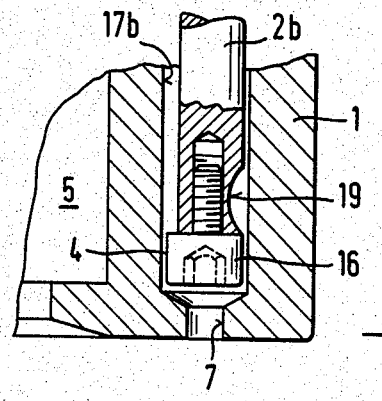

Another way of removing the shackle is shown in FIGS. 9–10. In this case no recess 9 is required at the guiding portion of the cylinder lock mechanism 5, but the head 4 of the longer shackle leg 2*b* has to be detachable from the general part of the leg when the mechanism is in locking or releasing position. When head 4 is detached and the cylinder lock mechanism is in releasing position, the shackle is free to completely leave the lock casing.

In one embodiment of the invention, shown in FIG. 9, the head 4 is connected to the general part of the longer leg by means of a screw 16 or the like. An opening 7 is arranged in casing 1. The dimension and the position of opening 7 are chosen so, that screw 16 is operable from the outside of the casing.

It is also advantageous to arrange the shackle head as an integral part of said screw, as shown in FIG. 10.

Figure 11:
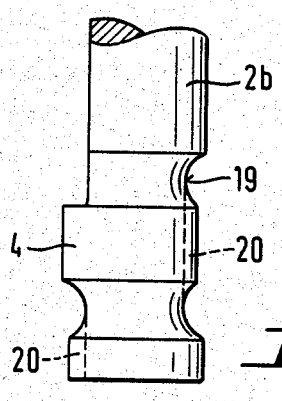
FIG. 11 shows a shackle head with a disengagement groove.

Still another way to make the disengagement of the shackle possible, is to provide the head 4 of the longer shackle leg with a groove 20, dimensioned to partly receive the locking member 6*b* when the latter is in its releasing position. It is essential in this case, to arrange this groove in such a way, that the removal of the shackle does not take place by accident. This can be achieved, for instance, by arranging the groove in steps, as shown in FIG. 11.

The invention is not limited to the embodiments shown, but several modifications thereof are feasible within the scope of the attached claims.

I claim:

1. A padlock comprising:

a lock casing, an essentially U-shaped shackle having two legs of different length each formed with a locking notch, said shackle being slidable in the lock casing between a closed position, in which each leg is partially within the casing, and an open position, in which the shorter leg is free of the casing and the longer leg is partially within the casing, the longer leg having a head which is somewhat thicker than the general part of the longer leg for retaining the shackle in engagement with the casing when the shackle is in the open position, a cylinder lock mechanism having a turnable member which is formed with a guiding portion and is turnable between a locking position and a releasing position, and first and second discrete locking members which coact with said guiding portion of the turnable member and are moved linearly away from each other by the guiding portion of the turnable member to engage the locking notches of the shorter and longer legs respectively when the shackle is in said closed position and the turnable member is turned from its releasing position to its locking position, whereby the two legs of the shackle are locked to said lock casing, and being able to move linearly towards each other to disengage from the locking notches and allow the shackle to slide to its open position when the turnable member is in its releasing position, and wherein the head of the longer shackle leg is formed with a first groove extending circumferentially of the longer leg and dimensioned to receive the second locking member when the turnable member is in its releasing position, to allow rotation of the shackle relative to the lock casing about the longer leg when the shackle is in the open position, and a second groove extending from the first groove to the end of the longer leg and dimensioned to receive the second locking member when the turnable member is in its releasing position, to allow disengagement of the shackle from the lock casing, said second groove including at least first and second portions extending substantially longitudinally of the longer leg at different circumferential positions about the longer leg and a third portion extending circumferentially of the longer leg and joining the first and second portions.

2. A padlock according to claim 1, wherein the lock casing is formed with at least one recess and the turnable member is provided with a biased indicator member which is engageable with said recess to indicate a turning position of the turnable member.

3. A padlock comprising:

a lock casing, an essentially U-shaped shackle having two legs of different length each formed with a locking notch, said shackle being slidable in the lock casing between a closed position, in which each leg is partially within the casing, and an open position, in which the shorter leg is free of the casing and the longer leg is partially within the casing, the longer leg having a head which is somewhat thicker than the general part of the longer leg for retaining the shackle in engagement with the casing when the shackle is in the open position, a cylinder lock mechanism having a turnable member which is formed with a guiding portion and is turnable between a locking position and a releasing position, and first and second discrete locking members which coact with said guiding portion of the turnable member and are moved linearly away from each other by the guiding portion of the turnable member to engage the locking notches of the shorter and longer legs respectively when the shackle is in said closed position and the turnable member is turned from its releasing position to its locking position, whereby the two legs of the shackle are locked to said lock casing, and being able to move linearly towards each other to disengage from the locking notches and allow the shackle to slide to its open position when the turnable member is in its releasing position, and wherein the turnable member is formed in its guiding portion with a recess which can receive the second locking member when the turnable member is turned from its locking position to a position beyond its releasing position, receiving of the second locking member in said recess causing complete disengagement of the longer leg from the lock casing.

4. A padlock according to claim 3, wherein the lock casing is formed with at least one recess and the turnable member is provided with a biased indicator member which is engageable with said recess to indicate a turning position of the turnable member.

5. A padlock comprising:

a lock casing formed with a recess, an essentially U-shaped shackle having two legs of different length each formed with a locking notch, said shackle being slidable in the lock casing between a closed position, in which each leg is partially within the casing, and an open position, in which the shorter leg is free of the casing and the longer leg is partially within the casing, the longer leg having a head which is somewhat thicker than the general part of the longer leg for retaining the shackle in engagement with the casing when the shackle is in the open position, a cylinder lock mechanism having a turnable member which is formed with a guiding portion and is turnable between a locking position and a releasing position, and first and second discrete locking members which coact with said guiding portion of the turnable member and are moved linearly away from each other by the guiding portion of the turnable member to engage the locking notches of the shorter and longer legs respectively when the shackle is in said closed position and the turnable member is turned from its releasing position to its locking position, whereby the two legs of the shackle are locked to said lock casing, and being able to move linearly towards each other to disengage from the locking notches and allow the shackle to slide to its open position when the turnable member is in its releasing position, means allowing disengagement of the shackle from the lock casing upon turning the turnable member at least as far as its releasing position, while leaving the cylinder lock mechanism in said casing, and a biased indicator member carried by the turnable member and engageable with said recess to indicate a turning position of the turnable member.

6. A padlock according to claim 5, in which the head of the longer shackle leg is detachable from the general part of said longer leg to allow disengagement of the longer leg from said casing.

7. A padlock according to claim 6, in which said head of the longer shackle leg is connected to the general part of said longer leg by means of a screw or the like, operable through a opening in said lock casing.

8. A padlock according to claim 7, in which said head of the longer shackle leg is an integral part of said screw.

9. A padlock according to claim 5, in which said turnable member is formed in its guiding portion with at least first, second and third recesses, said first and second recesses permitting the locking members to disengage from the locking notches when the turnable member is in its releasing position and the third recess permitting the second locking member to move farther from the longer leg of the shackle and to allow complete disengagement of said longer leg, including its head, from said casing.

10. A padlock according to claim 5, wherein the head of the longer shackle leg is formed with a groove to receive the second locking member when the turnable member is in its releasing position, so that the longer leg is disengageable from the casing by turning the shackle about the longitudinal axis of the longer leg in at least one step.

* * * * *